United States Patent [19]

Smith et al.

[11] Patent Number: 4,938,000

[45] Date of Patent: Jul. 3, 1990

[54] VARIABLE LOW-PRESSURE SEQUENTIAL-RETURN FORCE CAP LIFT

[75] Inventors: Rodney P. Smith, Moline, Ill.; Donald E. Cohrs, Davenport, Iowa

[73] Assignee: The Kartridg Pak Co., Davenport, Iowa

[21] Appl. No.: 423,873

[22] Filed: Oct. 19, 1989

Related U.S. Application Data

[63] Continuation-in-part of Ser. No. 266,507, Nov. 3, 1988, Pat. No. 4,875,324.

[51] Int. Cl.[5] ..... B65B 31/06; B65B 31/02; B65B 3/10

[52] U.S. Cl. ..... 53/88; 53/510; 53/268; 53/270; 53/330; 53/368

[58] Field of Search ..... 53/368, 268, 270, 470, 53/88, 89, 94, 269, 283, 510, 268, 330

[56] References Cited

U.S. PATENT DOCUMENTS

| | | | |
|---|---|---|---|
| 2,498,443 | 2/1950 | Naccarato et al. | 53/368 X |
| 2,958,170 | 11/1960 | Mayer, Jr. | 53/470 X |
| 2,963,834 | 12/1960 | Stanley et al. | 53/470 |
| 3,152,429 | 10/1964 | Stanley et al. | 53/88 |
| 3,157,974 | 11/1964 | Stanley et al. | 53/88 |
| 3,545,170 | 12/1970 | Leonard | 53/88 |
| 3,755,985 | 9/1973 | Rait et al. | 53/470 X |
| 3,889,451 | 6/1975 | Burkhardt | 53/368 X |
| 3,977,151 | 8/1976 | Reever et al. | 53/88 X |
| 4,086,741 | 5/1978 | Williams | 53/88 X |
| 4,875,324 | 10/1989 | Cohrs | 53/88 |

*Primary Examiner*—Horace M. Culver

*Attorney, Agent, or Firm*—Lockwood, Alex, FitzGibbon & Cummings

[57] ABSTRACT

A crimper head for use in introducing a fluid product under pressure into the mouth of a container provided with a closure and thereafter crimping the closure to the container mouth. A container, such as for an aerosol package, with a closure resting freely in the mouth of the container is delivered to the crimper head. The head has a lower bell which forms a seal with the upper end of the container when the head is lowered. While the bell remains stationary, other parts of the head are actuated so that vacuum is applied to the bell and the container while the closure is lifted by vacuum from the mouth. Thereafter, the head is actuated to shut off the vacuum and admit a metered quantity of fluid under pressure, such as aerosol propellant, into the bell and container. When the pressurized fluid is admitted it lifts the closure from the container mouth and also acts to lift as a unit all parts of the head except the bell which remains stationary and engaged with the container. The combined weight of the lifted parts augmented by a first hydraulic or pneumatic hold-down force resist the lifting action. After the desired quantity of propellant has been introduced, a second hold-down force is applied which in combination with the previously applied weight of the lifted parts and first hold-down force restores the lifted parts to their normal or lowered position. Thereupon, the collet in the head is actuated to crimp the closure to the mouth of the container.

13 Claims, 6 Drawing Sheets

33
36
32
35
31
31
5
34
34
40
39a
29
25
39b
26
37
22
21
41
17
38
30
24
28
95
23
96
10
16
27
27
15
18
93
94
48
57
43
48
58
54
50

VARIABLE LOW-PRESSURE SEQUENTIAL-RETURN FORCE CAP LIFT

This application is a continuation-in-part of application Ser. No 266,507 filed Nov. 3, 1988 issued as U.S. Pat. No. 4,875,324 on Oct. 24, 1989 and assigned to the assignee of the present invention.

SUMMARY OF THE INVENTION

This invention relates generally to innovations and improvements in crimper heads which are used in apparatus and equipment that fill containers with pressurized product and/or propellants to form various aerosol packages. A wide variety of products have been long and widely available in aerosol packages including such items as insecticides, paint, hair spray, lubricants, etc. The art of filling containers with various products and/or propellants is highly developed and high speed apparatus and equipment for performing the product and/or propellant filling operations is also highly developed and commercially available.

One of the important units in a production line for filling containers with product and propellant and applying closures thereto is known as the undercap filler. In a modern aerosol package production line, the undercap filler will usually have multiple crimping heads, e.g. 6–18 heads. Typically, containers are delivered to the undercap filler with product already introduced and with a closure assembly loosely set in the mouth of the container. The closure assembly includes in addition to the closure element or cap itself which seats on and becomes sealed to the mouth of the container, a dip tube extending down into the product and a discharge valve extending above the closure element. In each crimping head of an undercap filler, vacuum is first applied to the container, then a metered quantity of propellant in either liquid or gaseous form is introduced under pressure, after which the closure element is seated and crimped onto the mouth of the container.

One type of crimping head that has been used commercially with good success is disclosed in U.S. Pat. No. 3,157,974 issued Nov. 24, 1964 to Richard B. Stanley and Roy S. Rousseau, in particular, the crimping head disclosed in FIGS. 21–26 of U.S. Pat. No. 3,157,974 which operates in accordance with the modification and alternative operation described in column 15, lines 8–65. An improved crimping head design following the teachings of the Stanley and Rousseau U.S. Pat. No. 3,157,974 has been commercialized by the assignee of that patent, namely, The Kartridg Pak Co., of Davenport, Iowa. This improved commercial design will be referred to hereinafter.

The crimping head shown and disclosed in U.S. Pat. No. 3,157,974 and the successful commercial crimping head of The Kartridg Pak Co. rely on compression springs to restore lifted components of the crimping heads to their lowered position in which the closure element can be crimped to the container opening or mouth. In operation, certain components of these prior crimping heads are lifted against the force of the compression springs when propellant or product is introduced into the heads under pressure. In order to achieve satisfactory operation of these prior crimping heads, several disadvantages have had to be accepted and coped with. According to the present invention, it is possible to eliminate the compression springs and the disadvantages attendant thereto.

Generally stated, the object of the present invention is the provision of a crimping head wherein the known and recognized disadvantages attendant to and associated with crimping heads utilizing compression springs for restoring or lowering components or elements raised by action of the pressure of the propellant or other pressurized fluids, are eliminated and with the compression springs being replaced with other means resulting in important and worthwhile advantages.

More specifically, an important object of the present invention is the provision of crimper heads of the type disclosed in Stanley and Rousseau U.S. Pat. No. 3,157,974 and the commercial versions thereof available from The Kartridg Pak Co. in which the return compression springs have been eliminated and replaced with sequentially operated fluid pressure exerting means, and the following advantages have been obtained: improved safety, reduced wear, decreased propellant and operating pressures, elimination of high pressure propellant pumps which are costly and expensive to maintain, minimized lift resistance, adjustable closure sealing force, increased output, reduced propellant loss, entire container opening available during fill instead of a restricted slit clearance—thereby reducing tendency to dislodge closure gaskets, reduced seal loading, reduced can loading, and increased output.

Certain other objects of the invention will become apparent to those skilled in the art in view of the following detailed description of a presently preferred embodiment of the invention taken in conjunction with the accompanying drawings, wherein:

DETAILED DESCRIPTION

Figure 1A:
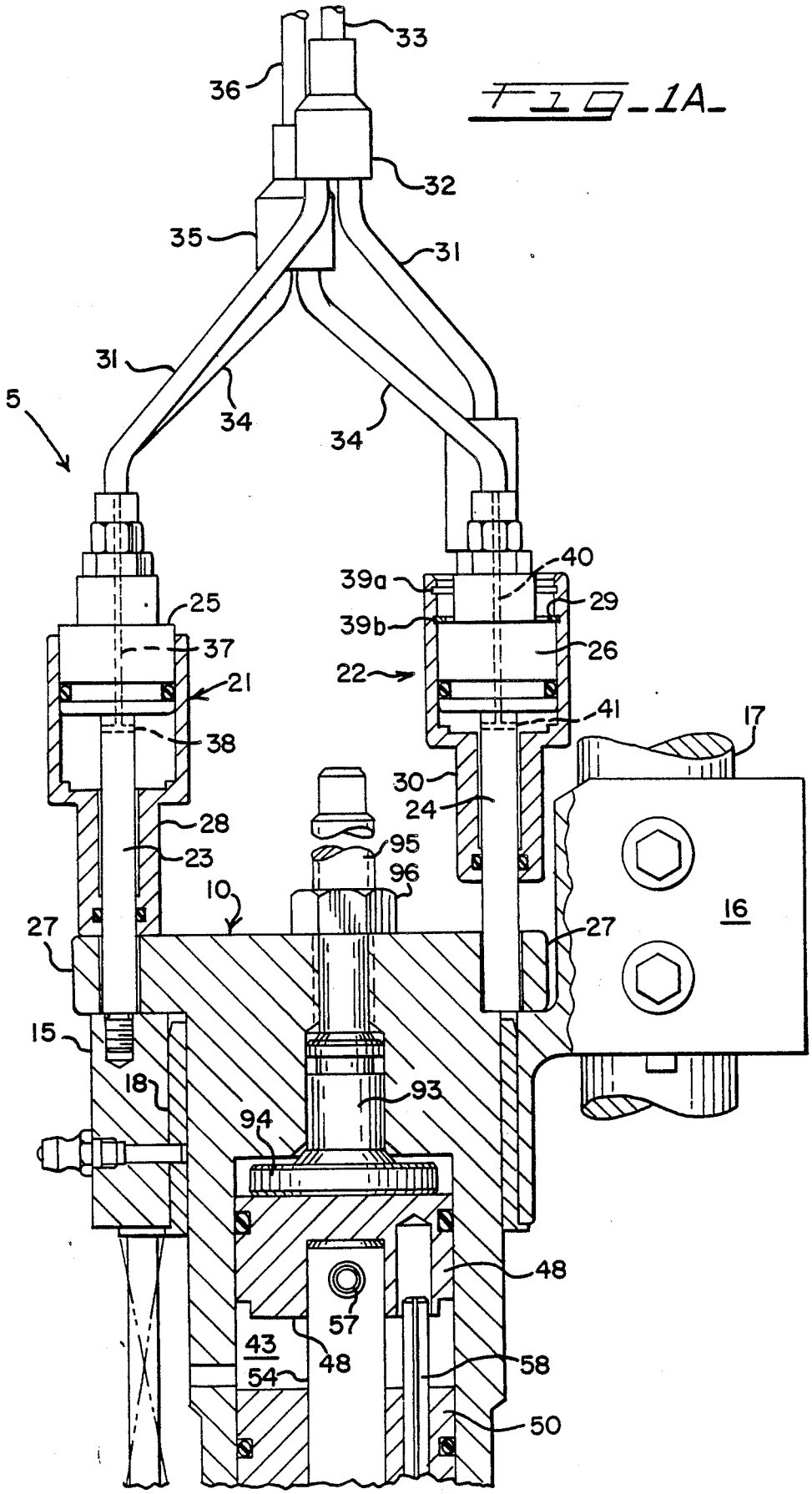
FIGS. 1A and 1B comprise a vertical sectional view, with certain parts shown in elevation, of a crimping head embodying the present invention taken generally on line 1—1 of FIG. 2 and showing the parts in their non-operating condition.
Figure 1B:
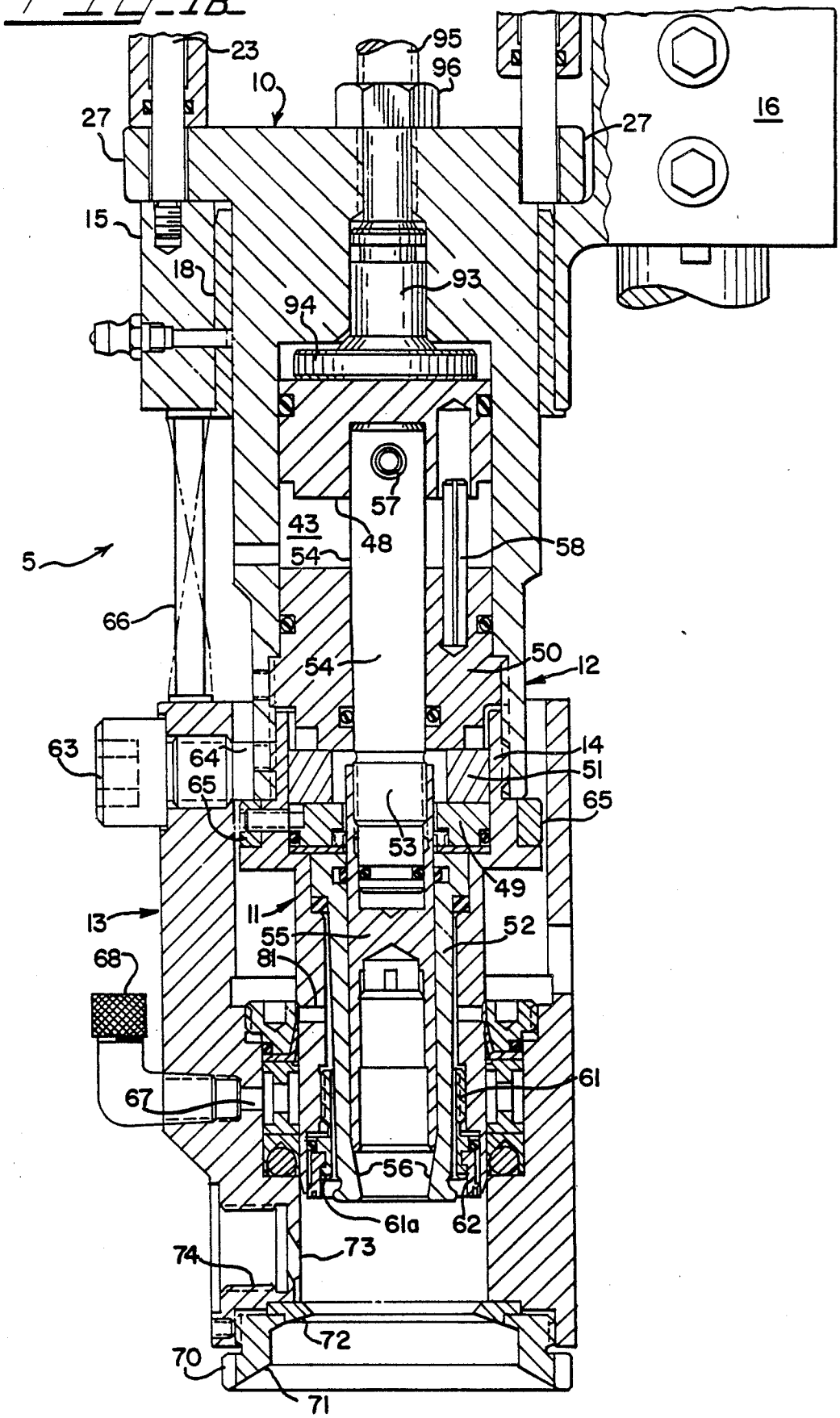

Referring to FIGS. 1–5, a crimping head is indicated generally at 5 which embodies the present invention. The head 5 comprises an upper cylinder head 10 to the lower end of which is attached a lower cylinder 11. The cylinder 11 and the lower end 12 of the upper cylinder head 10 are surrounded by an outer container-engaging bell 13. The lower end 12 of the upper cylinder head 10 is internally threaded so as to receive the upper threaded end 14 of the inner cylinder 11.

The crimping head 5 will normally be one of a number of heads (e.g. 6–18) incorporated in a propellant and/or product undercap filler of the general type shown and described in Stanley and Rousseau U.S. Pat. No. 3,157,974, the disclosure of which is incorporated herein by reference. The crimping head 5 will be mounted so as to be vertically slidable in the sleeve portion 15 of a bracket 16 carried by a cam actuated, vertically reciprocating post 17. As described in U.S. Pat. No. 3,157,974, the vertical reciprocation of the post 17 is controlled by a cam whereby the head 5 and related parts of the overall machine perform a certain cycle of key operations which are described below in connection with FIGS. 9–11.

The sleeve 15 is preferably provided with a bushing 18. The upper end of the upper cylinder head 10 is generally square as shown in FIG. 2 with four rounded corners whereby the head 5 can be suspended in the sleeve 15 with the four corners resting on the upper end of the sleeve 15 as shown in FIGS. 1A and 2.

Figure 2:
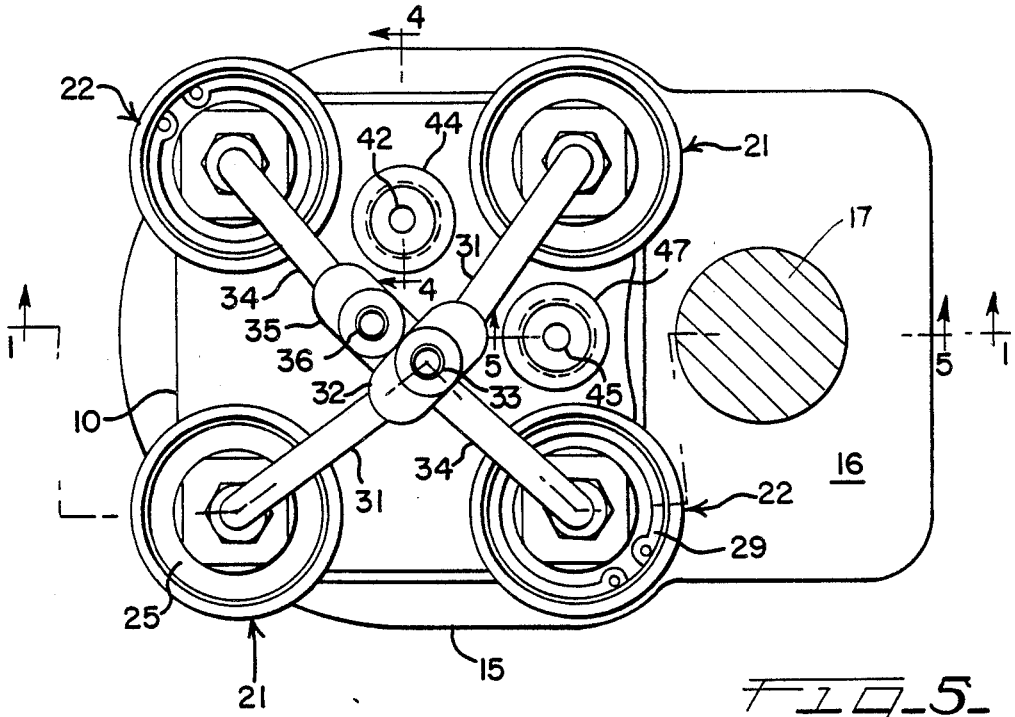
FIG. 2 is a top plan view of the crimping head shown in FIG. 1A.
Figure 4:
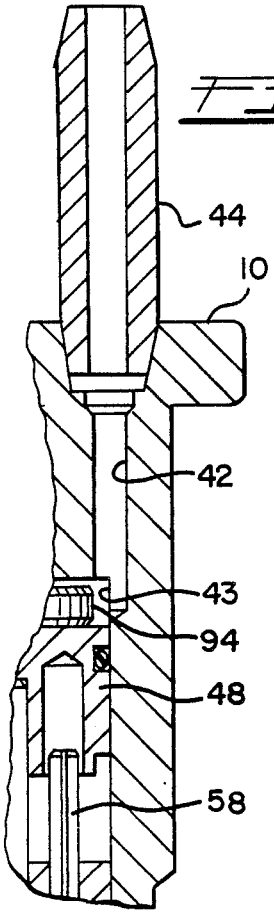
FIG. 4 is a fragmentary sectional view taken on line 4—4 of FIG. 2.
Figure 5:
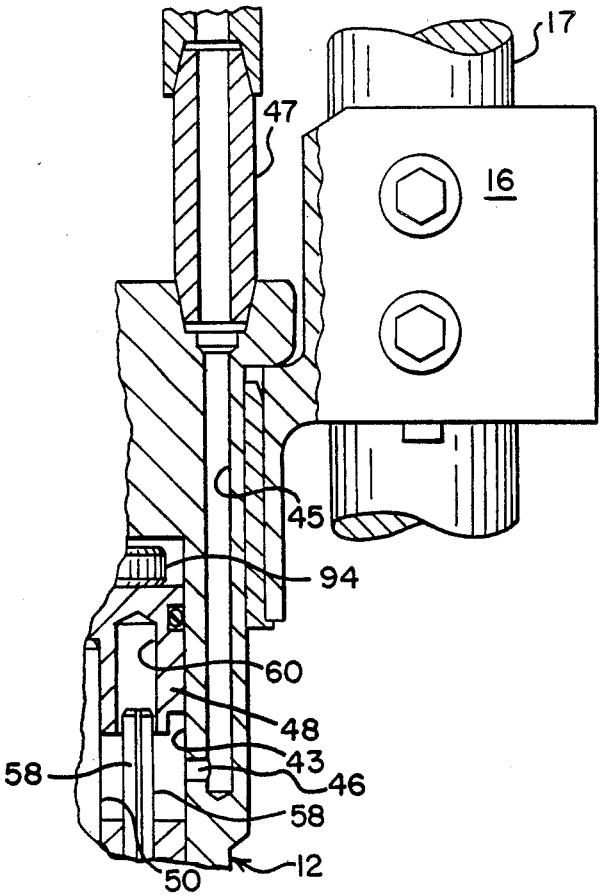
FIG. 5 is a fragmentary sectional view taken on line 5—5 of FIG. 2.
Figure 3:
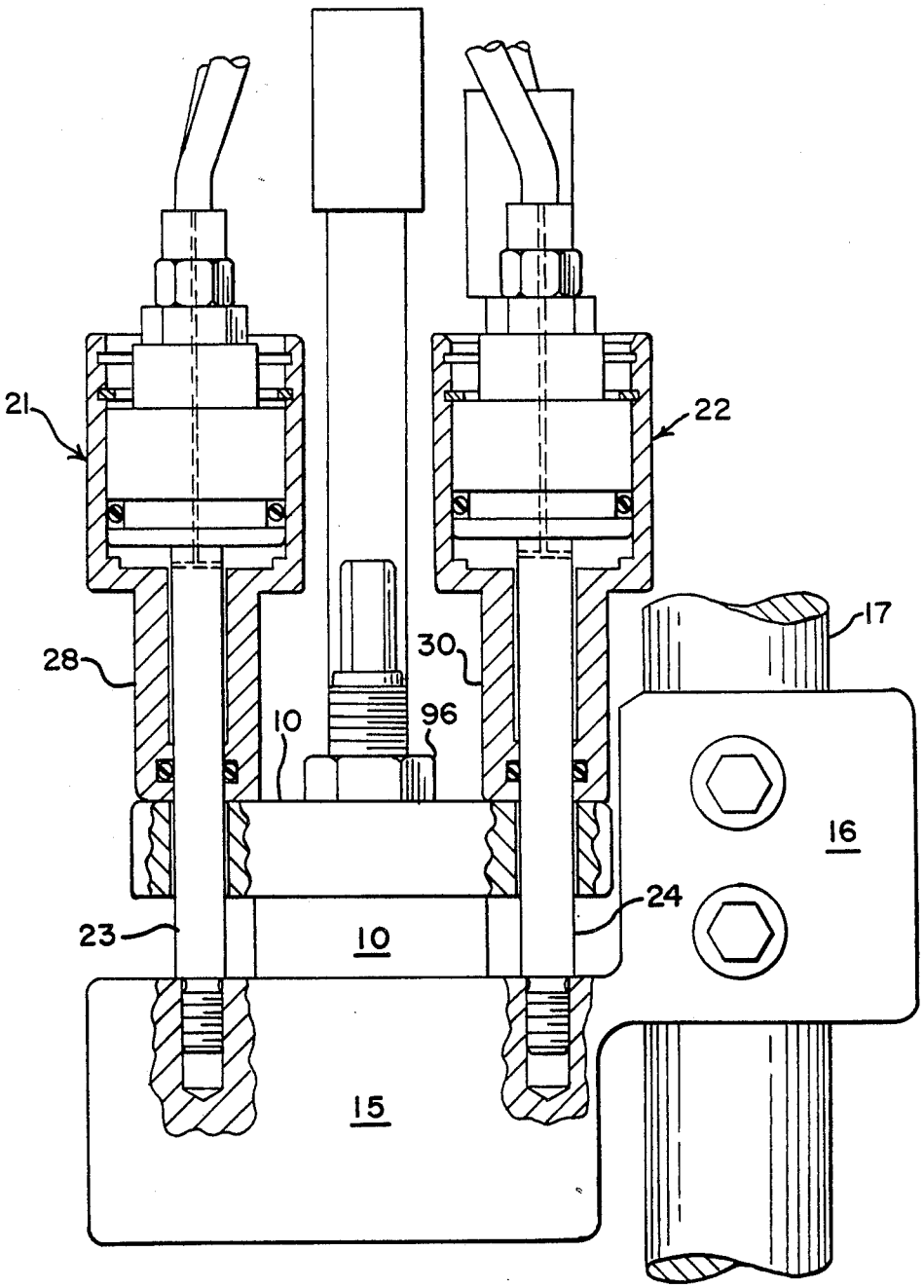
FIG. 3 is a fragmentary view based on FIG. 1 showing the raised condition of certain parts after propellant has been introduced.

Referring to FIGS. 1–3, four relatively small diagonally opposed, fluid-actuated cylinder units indicated generally at 21—21 and 22—22 (FIG. 2) are mounted above the head of cylinder 10 on piston rods 23—23 and 24—24, respectively. Pistons 25—25 and 26—26 are secured to the upper of rods 23 and 24 extend through smooth holes in ears 27—27 on the corners of the cylinder head 10. The bottom ends of the rods 23 and 24 are threaded and are screwed into tapped holes in the top of bracket sleeve 15 thereby anchoring the rods thereto. The cylinder units 21—21 and 22—22 have sleeve extensions 28—28 and 30—30, respectively, through which the rods 23 and 24 extend. In one condition of operation of the crimping head 5 the bottom ends of only sleeves 28 engage the top of cylinder head 10 as shown in FIG. 1A. In another condition of operation, the cylinders 21 are raised along with the cylinder head 10 as shown in FIG. 3. In operation pneumatic or hydraulic pressure is continuously supplied to the cylinder units 21—21 through lines 31—31 the upper ends of which open into a common fitting 32 from which a single line 33 extends to a suitable source of pneumatic or hydraulic pressure. Likewise, pneumatic or hydraulic pressure is continuously supplied to cylinder units 22—22 through lines 34—34 the upper ends of which open into a common fitting 35 from which a single line 36 extends to a suitable source of pneumatic or hydraulic pressure.

A vertical passageway 37 extends through the center of each piston 25 and provides communication between the pressure lines 31 and a transverse passageway 38 in each piston rod 23. Similarly, vertical passageways 40 extends through the centers of the pistons 26 and provide communication between the pressure lines 34 and a transverse passageway 41 in each piston rod 24.

The functioning of the cylinder units 21 and 22 will be discussed below in connection with the operation of the crimper head 5.

The upper cylinder 10 is also provided with counterbore vertical passageway 42 (FIGS. 2 and 4) which opens at its lower end into the upper end of cylinder 10 so as to provide a pressurized fluid connection into the main chamber 43 of the cylinder 10 above a piston 48 thereon. The upper end of the passageway 42 is threaded to receive the end of a nipple or coupling 44.

The cylinder head 10 is provided with another vertical passageway 45 for pressurized fluid (FIGS. 2 and 5) which at its bottom end communicates through a lateral port 46 into the main chamber 43 below the piston 48. At its upper end the passageway 45 is fitted with a nipple 47.

The piston 48 is located in the upper end of the main chamber 43 of the upper cylinder head 10 and in its uppermost position abuts against the underside of a vertically adjustable arcular plate 94 as shown in FIG. 1. The lower end 12 of the cylinder head 10 is closed by a cap or plug 50 which defines the bottom or closed end of the main chamber 43 and provides a stop for the downward travel of the piston 48. The plug 50 is screwed into the end of the lower portion 12 of the cylinder head 10 until a shoulder on the plug 50 engages a cooperating shoulder in the cylinder head 10.

The bottom end of the plug 50 is spaced from th upper end of the lower cylinder 11 by a washer 51 and seal ring retainer 49.

A closure cap crimping collet 52 is carried within the lower cylinder 11 and is actuated by a plunger 53 formed by an upper part 54 and a lower part 55 which projects downwardly through the collet 52 with a lower end thereof engaging the inner inclined or cam surfaces of the collet sections. At its upper end the upper plunger section 54 projects into the piston 48 and is secured thereto by a pin 57. The plunger section 54 slides vertically through a bore in the plug 50.

The plunger section 54 slides vertically through a bore in the plug 50. Preferably, rotation of the piston 48 is prevented by means of a pin 58, the lower end of which is fixed in a socket in the plug cap 50 and the upper end of which protrudes into a vertical bore 60 in the piston 48.

A stop sleeve 61 is screwed into the lower end of the lower cylinder 11 and a seal ring 62 is mounted between the lower ends of the stop sleeve 61 and the lower cylinder 11. The outer bell 13 is provided with one or more stop screws 63, the inner ends 64 of which protrude into the interior of the bell 13 so that when the bell is in its free lowered position the pins 63 rest on the top surface of a ring 65 carried on the upper end of the inner cylinder 11. The outer bell 13 is biased toward its downward position as shown in FIG. 1 by means of a plurality of compression springs 66 circumferentially spaced around the upper cylinder head 10 and compressed between the underside of the bracket sleeve 15 and the top surface of the bell 13.

The bell 13 is provided with a counterbore lateral passageway 67 which is provided with an elbow fitting 68 which will be coupled to a vacuum line. By means of the passageway 67, vacuum may be applied to the lower interior of the bell 13 including the collet 52 and the parts that surround it.

Preferably, the lower end of the bell 13 is fitted with an adapter ring 70 which has a lower inclined seating surface 71 adapted to engage the upper end of a container or can to be filled. Since the cans or containers may have different shapes and sizes at their upper ends, it is preferred that the adapter ring 70 be made removable instead of integral with the remainder of the bell 13 so that various adapter rings can be interchanged as required. An annular gasket 72 is captured between the upper inner end of the ring 70 and a recess in the lower end of the bell 13 so as to form a seal with a can or container at a location exterior of the mouth of the container or can.

In its center the head of the cylinder 10 has a vertical counter bore in the enlarged lower end of which the stem of a piston stop 93 is received which has on its bottom the circular plate 94 which serves as a stop for the piston 48. A bolt 95 is integrally joined to the stem 93 and protrudes above the top of cylinder 10 so as to receive a jam nut 96.

As mentioned above in one phase of the operation of the crimper head 5, propellant either gas or liquid, is introduced under pressure into the container being filled after it has been vacuumized. Accordingly, the lower end of the bell 13 is provided with an inclined propellant inlet passageway 73 which communicates with an internally threaded port 74 in the bell sidewall.

Operating Sequence For Vacuumizing, Filling and Sealing

Figure 9:
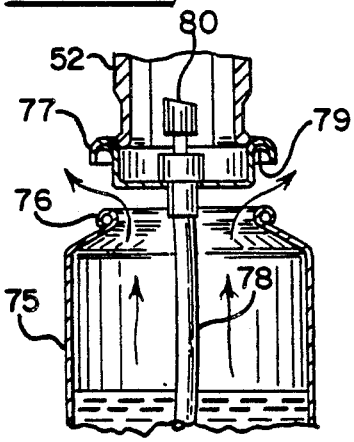
FIGS. 9, 10 and 11 are diagrammatic views illustrating relative positions of the closure cap and collet during the vacuum, pressure fill and crimping operations, respectively.
Figure 10:
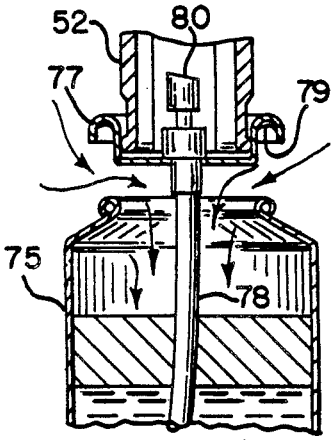
Figure 11:
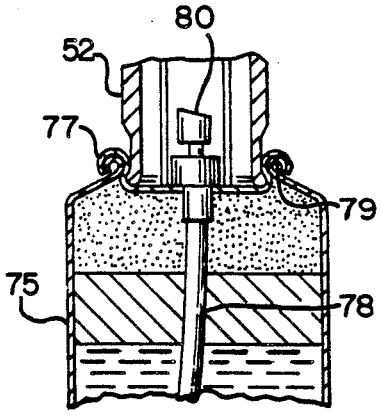

When the crimper head 5 is suspended from the support sleeve 15 and no container or can is located beneath the head, the parts of the head will occupy the relative positions shown in FIG. 1. A container to be filled with pressurized propellant (and/or product) will be automatically delivered and accurately positioned underneath the head 5. Such a container or can is illustrated in FIGS. 9–11 at 75. The can 75 has a rolled rim mouth 76 to which will be sealed and crimped a closure 77 which usually is preassembled with a dip tube 78 and spray nozzle 80. The closure rim is lined with a top gasket 79 of known type. When the container 75 is delivered to the crimper head 5, the closure 77 and its assembled parts will normally be loosely resting in place on the mouth 76.

Figure 6:
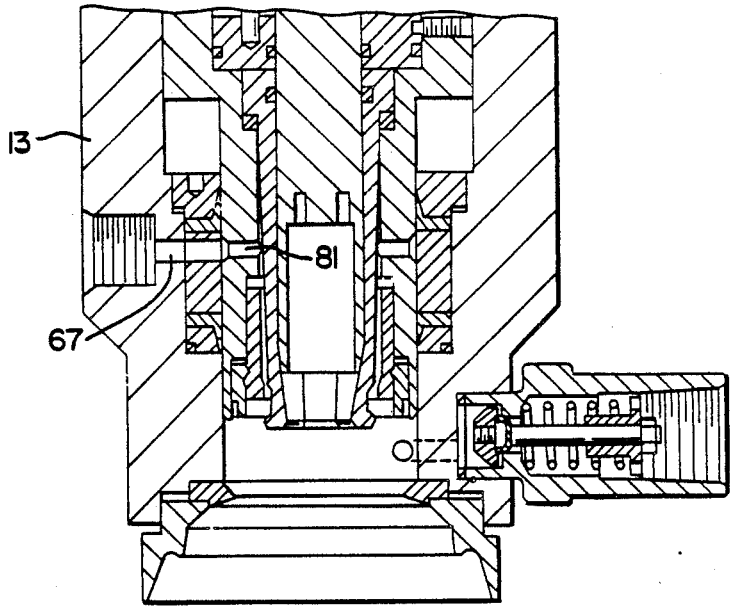
FIGS. 6, 7, and 8 are fragmentary sectional views showing the parts contained in the lower portion of the crimping head shown in FIG. 1 occupying three different positions corresponding to vacuumizing, propellant filling and closure crimping operations, respectively.

The cam operated and controlled support post 17 will be actuated so as to lower the crimper head 5 whereby the adapter 70 engages the top of the container 75 and the gasket 72 forms a seal with the container around the outside of the rim or closure mouth 76. As the head 5 is further lowered, the upper cylinder head 10 and lower cylinder 11 and the component parts carried thereby will be lowered while the bell 13 remains stationary. This lowering movement continues until the lateral passageway 81 (FIG. 1B) in the lower cylinder 11 comes into registry with the vacuum port 67 as shown in FIG. 6 whereupon vacuum can be applied to the bottom end of the bell 13 and to the container 75. The vacuum will lift the closure 77 and its assembled parts from the mouth 76 of the container 75 as illustrated in FIG. 9 so that any residual air or vapor within the container 75 and within the lower portion of the bell 13 will be removed. The condition and relative positions of the parts of the crimper head 5 during the vacuumizing step are shown in FIG. 6. The parts will remain in the relationship shown in FIG. 6 until the vacuum step is complete whereupon the post 17 is further lowered and the parts will occupy the relative positions shown in FIG. 7. In this position, it will be seen that the stop surface of the stop sleeve 61 will rest on the top surface of the closure 77 which in turn will rest on the container mouth 76. At this point in the cycle of operation, propellant or product in either liquid or gaseous form is introduced under pressure into the lower end of the bell through the passageway 73 and port connection 74. The resultant pressure build-up in the lower end of the bell 13 will cause the closure 77 and the lower cylinder 11 and the upper cylinder head 10 and all of the parts secured thereto to rise while the bell 13 remains stationary by reason of the downward force exerted thereon by the compression springs 66. Since the pistons 25 and 26 are held stationary, the cylinder head 10 will rise until it engages bottom end of the sleeves 30. It will be seen lifting of the cylinders 21 and their sleeves 28 is resisted by the downward thrust of the pressure within these cylinders. By selecting the desired pressure, the overall resistance to lifting of cylinder 10 and associated parts can be suitably regulated or controlled. This enables the machine operator to set the crimper head to provide enough downward force to reliably establish the cap seal prior to introduction of propellant and also provide the desired freedom of lift without resorting to compression spring opposition during filling.

Figure 7:
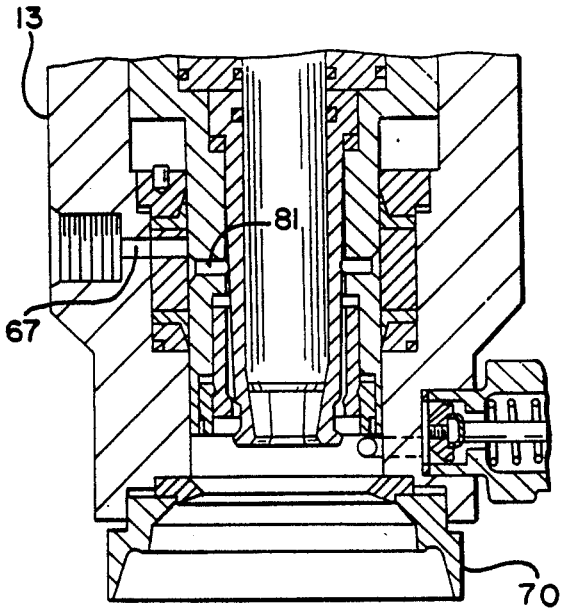
Figure 8:
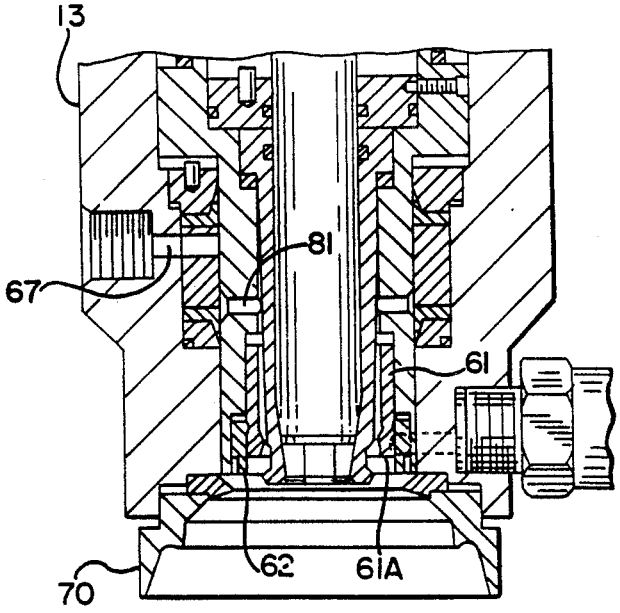

When the introduction of pressurized propellant or other fluid has ceased as described in the Stanley and Rousseau U.S. Pat. No. 3,157,974, the pressure will still be trapped in the bottom of the bell 13 and in the headspace of the container 75 so that the condition of the crimper head parts will remain as shown in FIGS. 3 and 7 with the and cylinder head 10 and cylinder units 21 lifted. At this point in the operating cycle, the machine operates to lift the container a small distance (e.g. 3/16 to 7/16 of an inch) thereby raising the cylinders 22 a corresponding distance depending on which of the grooves **39*a* and 39*b* the snap rings 29 is inserted. Prior to this lifting of the container and corresponding raising of the cylinders 22, downward movement of the cylinders 22 has been prevented by the engagement of the snap rings 29 against the pistons 26. The combined downward forces exerted by the cylinders 21 and 22 will suffice to force the upper cylinder head 10 and parts assembled thereto downward until their movement is arrested by contact of the closure 77 with the container mouth 76. During this downward movement, the parts assembled to the cylinder head 10 and to the lower cylinder 11 are lowered to their relative positions shown in FIG. 8 and diagrammatically illustrated in FIG. 11. In this condition, the closure 77 is seated on the container mouth 76 and the lower ends of the collet segments engage the closure cap 77 inwardly of its outer downwardly curved annular rim. The bottom end 61A of stop sleeve 61 (FIG. 8) will be engaged with the top of the closure cap and seal ring 62 will engage the outer periphery of the closure cap. Hydraulic fluid under pressure is now admitted through the nipple 44 and the passageway 42 (FIG. 4 into the space 43 in the upper cylinder head 10 by way of the nipple 44 whereby the hydraulic fluid under pressure is applied to the top surface of the piston 48. The piston and the collet actuating plunger 53 are forced downwardly causing the bottom ends of the collet segments to spread apart and thereby crimp the closure 77 with its gasket 79 to the mouth 76 of the container 75. When the crimping action has been completed, the hydraulic fluid that has entered above the piston 48 and below the closure cap 27 will be vented while hydraulic fluid under high pressure is admitted into the passageway 45 (FIGS. 2 and 5) so as to enter the space 43 between the underside of the piston 48 and the top of the plug cap 50. As the piston 48 is forced upwardly by reason of this pressurized hydraulic fluid above the piston 48 will be expelled through the passageway 42**.

In actual practice, the cycle of operations described above with respect to the crimping head 5 will be carried out in about 2 seconds once the bell 13 of the head has been seated on the can or container 75.

The Prior Art

Figure 12:
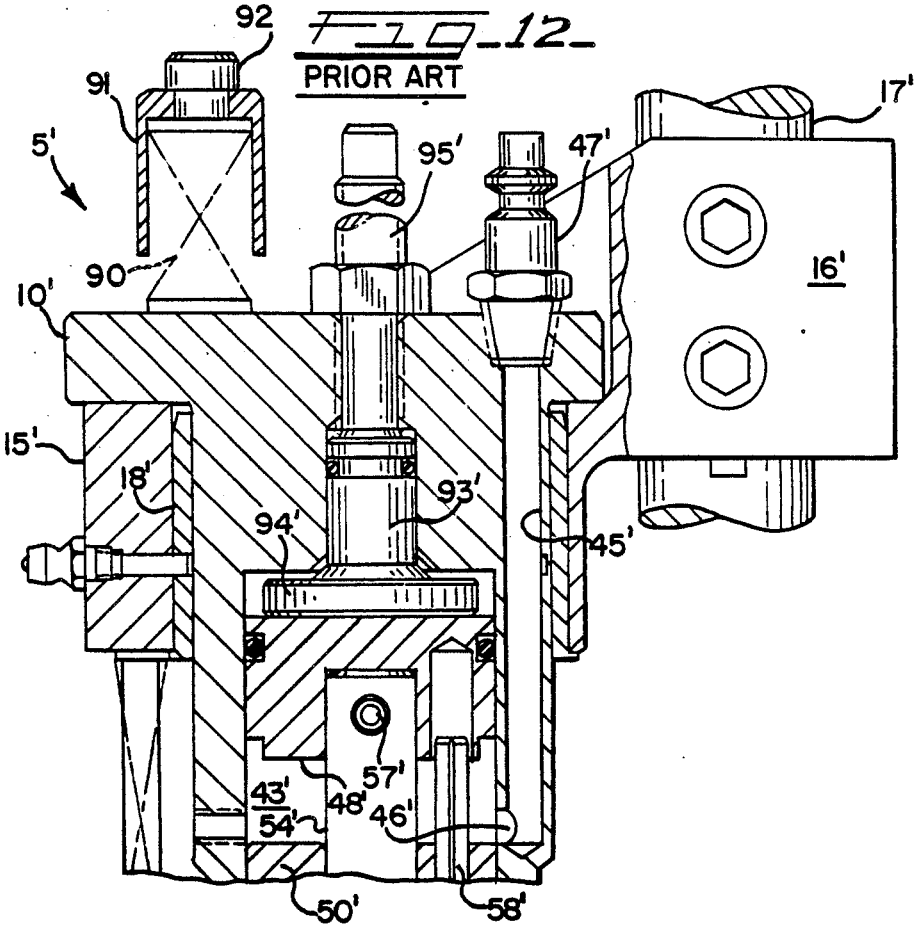
FIG. 12 PRIOR ART
FIG. 12 is a fragmentary vertical sectional view of the upper portion of a crimping head representing the current state of the prior art.

For a description of the prior art as it relates to the crimper head reference may be had to FIG. 12 wherein component parts corresponding to those of the crimper head 5 are indicated by corresponding reference numerals with primes. In the prior art crimper head 5' the upper cylinder head 10' is continuously biased against lifting by four preloaded compression springs 90—90 the upper ends of which are enclosed in tubular caps 91 against the top of which the heads of anchor bolts 92 are engaged, with the lower ends of these bolts extending downwardly into the support sleeve 15'. Thus, in order for the components of the crimper head 5' other than its stationary outer bell (not shown) to lift, the pressure within the lower end of the bell must be sufficient to overcome the downward compression force of the springs 90. On the other hand, when introduction of propellant or other pressurized product during fill-phase of the operation has been completed, the force of the springs 90 must be sufficient so as to return the upper cylinder head 10' and its associated parts against the force of the residual pressure so that the closure is seated against the mouth of the container being filled.

In the crimper head 5', there is a center bore through the upper end of the cylinder head 10' which in the lower part receives a piston stop 93' which has on its bottom end a circular plate 94' which engages the upper surface of the piston 48'. Hydraulic fluid under pressure is introduced to the top of the piston 48' through a passageway (not shown) in the upper cylinder head 10'. The collet actuating plunger 54' is forced downwardly when hydraulic fluid under pressure is introduced to the top of piston 48' thereby forcing the piston 48' downwardly. The piston 48' is returned to its upward position shown in FIG. 12 by admission of hydraulic fluid under pressure through the passageway 45' into the chamber 43 beneath the piston 48'.

The embodiment of the crimper head 5 shown in FIG. 1 has the following above-mentioned advantages over the crimper head 5' of the prior art shown in FIG. 12: improved safety, reduced wear, decreased propellant and operating pressures, elimination of high pressure propellant pumps which are costly and expensive to maintain, controllable reduced lift resistance, earlier positive closure sealing, increased output, reduced propellant loss, entire container opening available during fill instead of a restricted slit clearance thereby reducing tendency to dislodge closure gaskets, adjustable closure-gasket compression, reduced seal loading, reduced container loading, and increased output.

While the crimper head 5 of FIGS. 1–8 has been described for use in an undercap filler type of operation, the same crimping heads can be used for crimping closure caps onto containers, omitting the undercap filling operation. Thus, the crimper head 5 can be supplied with containers that will usually already have been filled with product and on which the closure cap assemblies have already been set or inserted in place on the containers. Usually, it will be desired to draw a vacuum on the containers and this step may be performed as described above, particularly in connection with FIGS. 6 and 9. Following the vacuum step the upper cylinder head 10 and the associated parts can be lowered by the operating rod 17 so that the closure cap is seated on the container and ready for crimping as described in connection with FIGS. 8 and 11. In this sequence, it will be noted that the undercap introduction of pressurized product or propellant through the opening 73 will have been omitted. With the crimper head in the condition illustrated in FIGS. 8 and 11, hydraulic pressure is introduced into the cylinder units 22 to apply a desired preload force of the lower end 61A of the stop sleeve 61 against the top of the closure 77. With this preload or hold-down force of the desire magnitude being applied, the collet 55 is actuated by a admitting pressure though the passageway 42 thereby forcing down the piston 48 as previously described and crimping the closure 77 to the mouth 76. Thereafter, propellant under pressure can be introduced in known manner through the valve 80 in a so-called pressure-filler.

It will be understood that the preload or hold-down pressure applied by means of the cylinder units 21 and 22 may be varied to suit the specifications for different types of closure caps lined with different types of gaskets 79. Thus, the desired preload or hold-down forces can be achieved by regulating the pressure applied to the cylinder units 21 and 22. Such pressure regulation can be readily obtained in any desired known manner.

What is claimed is:

1. In a crimper head for use in introducing fluid under pressure into the mouth of an open container provided with an unsecured closure and thereafter crimping the closure to said mouth comprising, an upper cylinder closed at its upper and lower ends and having flange means which can rest on a support sleeve in which it is vertically reciprocal, a piston operable in said upper cylinder, a lower cylinder attached to said lower end of said upper cylinder and depending co-axially therefrom, a hollow collet co-axially mounted in said lower cylinder, plunger means attached at its upper end to said piston and extending downwardly through a bore in said lower end of said upper cylinder and into said collet for distending the bottom end of said collet, a container-engaging bell surrounding said lower cylinder and the lower end of said upper cylinder and reciprocal with respect to said lower cylinder and said lower end of said upper cylinder, said bell and said lower cylinder having cooperating transverse vacuum-transmitting passageways arranged to register only when said bell occupies a particular vertical position relative to said lower cylinder to thereby establish vacuum communication through said bell and said lower cylinder into an annular clearance region that encircles said collet internally of said lower cylinder and which region opens downwardly into the lower end of said bell for communication with said container, said bell having a second passageway for admitting fluid under pressure into the lower portion of said bell and into a said container engaged by said bell, said upper cylinder having a passageway communicating from its exterior into its interior at a location above said piston and a second passageway communicating from its exterior into its interior below said piston, and all the above mentioned elements of said head except said bell being collectively vertically reciprocal as a unit between raised and lower positions with respect to said bell when the latter stationarily engages a said container and being collectively lifted with respect to said container-engaging bell and said support sleeve when fluid under sufficient pressure is admitted into said bell through said second passageway, the improvement comprising: means for controlling the raising and effecting the lowering of said collectively lifted elements of said crimper head as a unit against the lifting force of fluid admitted under pressure into the lower portion of said bell, comprising fluid pressure exerting cylinder means operatively connected with said upper cylinder and having one operating mode in which said cylinder means controllably resists the raising of said collectively lifted means and a second operating mode in which said cylinder means effects the lowering of said collectively lifted means.

2. The improvement called for in claim 1 wherein said fluid pressure exerting cylinder means comprises at least two separate cylinder units one of which exerts pressure only during said second operating mode.

3. The improvement called for in claim 2 wherein each of said separate cylinder units includes a piston anchored to a part of said crimper head which remains vertically stationary when said collectively lifted lelents are being lifted and lowered.

4. The improvement called for in claim 3 wherein each said piston includes a downwardly extending rod which is anchored to said support sleeve.

5. The improvement called for in claim 2 wherein there are four separate cylinder units two of which exert pressure only during said second operating mode.

6. The improvement called for in claim 5 wherein two of said cylinder units exert pressure during both said first and second operating modes.

7. The improvement called for in claim 2 wherein there are four separate cylinder units positioned at four corners of a generally square configuration a first pair of said cylinder units being diagonally opposed and operable only during said second mode and a second pair of said cylinder units being diagonally opposed and operable during both said modes.

8. The improvement called for in claim 7 wherein each of said four cylinder units comprises, a piston mounted on the upper end of a piston rod the lower end of which is anchored to a part of said crimper head that is vertically stationary both when said collectively lifted elements are being lifted and lowered, and a vertically recirpocable cylinder in which a said piston is disposed, each said cylinder of said cylinder units having a downwardly extending sleeve which is slidable on the piston rod of its associated cylinder unit, the bottom end of each of said sleeves of said second pair of cylinder units having bearing engagement with the top of said upper cylinder during both of said operating modes, the bottom end of each of said sleeves of said first pair of cylinder units having bearing engagement with the top of said upper cylinder unit only during said second operating mode, conduit means for conducting fluid under pressure to each of said four cylinder units so as to act on the underside of each said piston therein and thereby continually downwardly bias its associated cylinder, and restraining means within each cylinder of said first pair of cylinder units resisting said downward bias and preventing its associated sleeve from exerting a downward thrust on the top of said upper cylinder only during said second mode.

9. The improvment called for in claim 8 wherein said restraining means comprises a snap ring inserted in a circumferential retaining groove in the cylinder interior and having a circumferential protruding portion which engages the top of the piston within the cylinder.

10. The improvement called for in claim 9 wherein there are a plurality of said retaining grooves which are axially spaced.

11. In a crimper head as called for in claim 10 wherein said cylinder means mounted above and operatively connected with said closed upper end of said upper cylinder comprises at least one cylinder continuously supported by engagement with the top of said closed upper end.

12. In a crimper head as called for in claim 11 aid cylinder means comprising a plurality of said one cylinder symmetrically positioned with respect to the axis of said upper cylinder.

13. In a crimper head as called for in claim 12 said means for fixedly supporting said fixed piston means comprises stems depending from said fixed piston means and secured in said support sleeve.

* * * * *

UNITED STATES PATENT AND TRADEMARK OFFICE

CERTIFICATE OF CORRECTION

PATENT NO. : 4,938,000

DATED : July 3, 1990

INVENTOR(S) : Rodney P. Smith and Donald E. Cohrs

It is certified that error appears in the above-identified patent and that said Letters Patent is hereby corrected as shown below:

Column 3, line 28, after "upper" insert --ends--; "23" should read "23-23"; "24" should read "24-24"; before "extend" insert --respectively. The lower ends of rods 23 and 24--.

Column 4, line 18, "th" should read "the".

Column 6, line 47, after "4" insert -- ) --.

Signed and Sealed this

Second Day of July, 1991

*Attest:*

HARRY F. MANBECK, JR.

*Attesting Officer*

*Commissioner of Patents and Trademarks*